US006175689B1

(12) United States Patent
Blanco, Jr.

(10) Patent No.: US 6,175,689 B1
(45) Date of Patent: Jan. 16, 2001

(54) IN-LINE TANKLESS ELECTRICAL RESISTANCE WATER HEATER

(76) Inventor: Byron Blanco, Jr., 141 Calle Iglesia, San Clemente, CA (US) 92672-7501

( * ) Notice: Under 35 U.S.C. 154(b), the term of this patent shall be extended for 0 days.

(21) Appl. No.: 09/329,976

(22) Filed: Jun. 10, 1999

(51) Int. Cl.[7] ..... F24H 1/10
(52) U.S. Cl. ..... 392/485; 392/474; 392/475
(58) Field of Search ..... 392/465, 474, 392/475, 476, 485, 487, 488, 489

(56) References Cited

U.S. PATENT DOCUMENTS

| | | | | |
|---|---|---|---|---|
| 2,791,671 | * | 5/1957 | Price | 392/474 |
| 2,903,551 | * | 9/1959 | Fischer | 392/474 |
| 3,560,706 | * | 2/1971 | Fonseca | 392/485 |
| 4,514,617 | * | 4/1985 | Amit | 392/485 |
| 4,762,980 | | 8/1988 | Insley . | |
| 4,924,069 | * | 5/1990 | Giordani | 392/485 |
| 5,277,152 | * | 1/1994 | Liao | 392/485 |
| 5,285,717 | * | 2/1994 | Knepler | 392/485 |
| 5,400,432 | * | 3/1995 | Kager et al. | 392/485 |
| 5,408,578 | * | 4/1995 | Bolivar | 392/485 |
| 5,437,003 | | 7/1995 | Blanco . | |
| 6,061,499 | * | 5/2000 | Hlebovy | 392/485 |
| 6,080,973 | * | 6/2000 | Thweatt, Jr. | 392/485 |

* cited by examiner

*Primary Examiner*—Teresa Walberg
*Assistant Examiner*—Fadi H. Dahbour
(74) *Attorney, Agent, or Firm*—James G. O'Neill

(57) ABSTRACT

An improved "in-line" tankless electrical resistance water heater includes a top having a cold water inlet and a hot water outlet for connection to the cold, and hot water lines of a faucet in a sink. The water heater includes a body with a passageway through which cold water travels, from the top towards the bottom, where it is fed into two separate chambers on opposed sides of a diaphragm. A first of the two chambers has no outlet, and the pressure of cold water therein presses against a first side of the diaphragm, while the second chamber includes an outlet to a further chamber having a heating element therein. The second chamber also includes a plunger, biased by a spring against a second side of diaphragm, and a plunger rod, which contacts an operating member of a microswitch. When a hot water handle of the faucet is opened, water travels from the further chamber to lower the cold water pressure in the second chamber and flex the resilient member toward the microswitch, to move the operating member and actuate the microswitch, so that the heating element is switched on. When the hot water handle is closed, the pressure in the two chambers will be equalized, and the spring will push the resilient member back to shut off the heating element.

20 Claims, 2 Drawing Sheets

IN-LINE TANKLESS ELECTRICAL RESISTANCE WATER HEATER

BACKGROUND OF THE INVENTION

1. Field of the Invention

This invention relates generally to water heaters, and, more particularly, to an improved "in-line" electrical resistance water heater.

2. Description of Related Art

Electrical resistance "in-line" water heaters are well known in the art. An example of such a water heater is set forth in U.S. Pat. No. 5,437,003 to Blanco ("003"). The disclosure of the '003 patent is incorporated herein, in its entirety, by this reference thereto. The Blanco patent discloses a unitary electrical resistance "in-line" tankless water heater, having a body, which is separated into three stacked compartments sections of circular configuration, and formed of molded, non-conducting plastic material. The lower compartment includes a terminal block for connection to a power supply conduit. An upper compartment encloses a circular heating coil element, and includes a top cover member, having a cold water inlet port and a hot water outlet port. An intermediate compartment encloses a microswitch, which is electrically connected to the power leads via the terminal block in the lower compartment, and to the terminals of the heating coil in the upper compartment. Furthermore, a water flow sensing mechanism is provided within the upper compartment, which, upon sensing water flow between the cold water inlet port and the hot water outlet port, actuates the microswitch within the intermediate compartment to energize the heating coil so as to produce hot water based upon the flow demand therefor.

The in-line tankless hot water heater disclosed and claimed in the '003 patent provides an improvement in the art, which is still useful today. However, the present invention provides an improved in-line tankless water heater of different configuration, and improved efficiency, for use in place of or complementary to the hot water heater disclosed in the '003 patent.

SUMMARY OF THE INVENTION

Accordingly, it is a general object of the present invention to provide an improved and simplified "in-line" tankless electrical resistance water heater of compact size. It is a particular object of the present invention to provide an improved continuous flow electrical resistance "in-line" tankless water heater, which can be easily installed and serviced. It is another particular object of the present invention to provide an improved "in-line" tankless electrical resistance water heater having an elongated water-holding compartment with a heating element contained therein. It is yet another particular object of the present invention to provide an improved "in-line" tankless electrical resistance water heater for providing improved continuous flow of hot water, and which is instantaneously responsive to the demand for hot water. And, it is still another particular object of the present invention to provide an improved "in-line" tankless electrical resistance water heater in which the incoming water flows through a dedicated passageway in the water heater body to the bottom of the body to both deliver hot water and to operate a control device for actuating the water heating element.

These and other objects of the present invention are achieved by providing an improved "in-line" tankless electrical resistance water heater in which cold water enters a top inlet of a body and flows through a dedicated passageway in the body to a bottom of the body. Adjacent the bottom of the body, the cold water flows into two separate water chambers, a first of which has an inlet, but no outlet, to thereby only allow cold water to exert pressure against a resilient diaphragm for actuation of a plunger. A second water chamber adjacent the bottom of the housing has both a cold water inlet and a cold water outlet to a compartment having a heating element therein. This second water chamber exerts a further pressure against an opposite side of the resilient diaphragm to force the plunger into an opposite direction. When a hot water faucet connected to an outlet of the water heater is opened, the heating element is actuated to instantly heat the water in the compartment. When the hot water faucet is shut off, pressure actuated against the diaphragm will be reversed, to cut off the heating element.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

Figure 1:
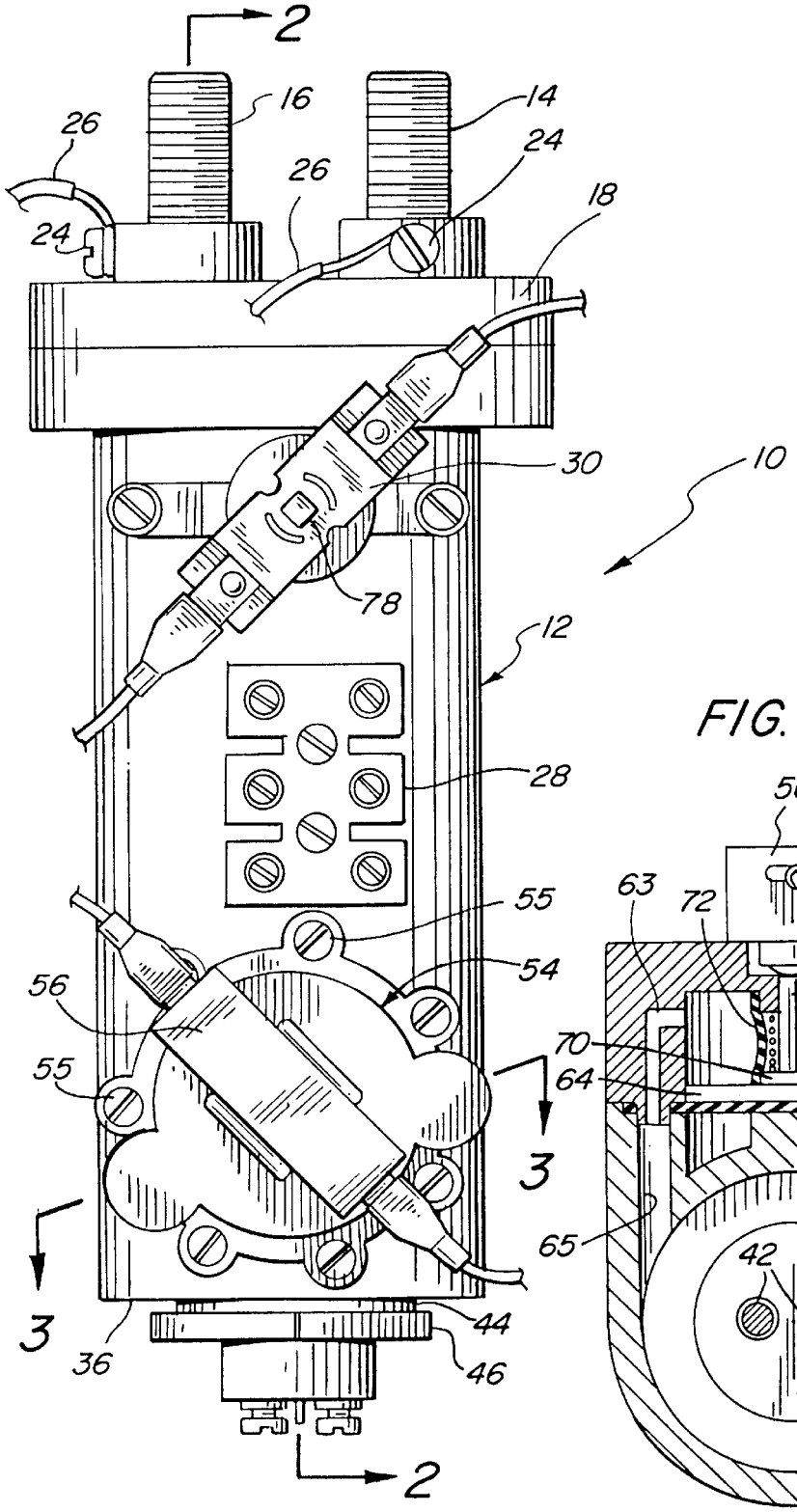
FIG. 1 is an front elevational view of a preferred embodiment of the improved "in-line" tankless electrical resistance water heater of the present invention.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified "in-line" tankless electrical resistance water heater generally indicated by the numeral 10. This water heater is for interconnection between an electrical power supply, a cold water inlet line and a hot water supply line under a sink, or the like, having separate or unitary hot and cold water taps.

As shown in the drawings, the improved water heater 10 of the present invention includes a body or housing 12 preferably made from a flame-retardant plastic, such as ZYTEL by Dupont and/or ABS manufactured by G.E. The body 12 may be molded or otherwise fabricated, in any desired size or shape, so as to be a unitary element having a cold water inlet 14, preferably made from a metal, such as brass, and a hot water outlet 16, preferably made from the same material, secured to a first or top end, as by a manifold 18, releasably held to the body 12. The manifold 18 is releasably secured in place by a plurality of fastening elements 20, such as screws, or the like, captured in holding elements 22, such as metal inserts, held in openings formed around the top end of the body 12. The cold water inlet 14 and the hot water outlet 16 are preferably grounded, as by means of metallic elements 24, such as screws, or the like, connected to ground wires 26. The ground wires 26 are preferably connected to a terminal block 28 mounted on an elevated portion 29 of the body 12, preferably at the front the body. In addition, the front of the body includes releasably-mounted on an extending portion thereof, a high-temperature limit switch 30. The high-temperature limit switch 30 is connected to the terminal block 28, and to a sensing element 32 extending into a compartment or heating space 34, formed within the body 12.

Additionally, a lower end 36 of the body 12 is preferably closed off by a wall, except for an opening 38 formed therein. The opening 38 is preferably threaded, and captures a threaded end 40 of a heating element 42. A sealing gasket or O-ring 44 is held between a raised lip 46 of the threaded end 40 and the end wall 36 of the body 12, to prevent water leakage. The top end of the body also includes a sealing element 48, such as a gasket, O-ring, or the like, which may be held in an annular groove formed in the top manifold 18, or the top portion of the body 12, to prevent water leakage.

Figure 3:
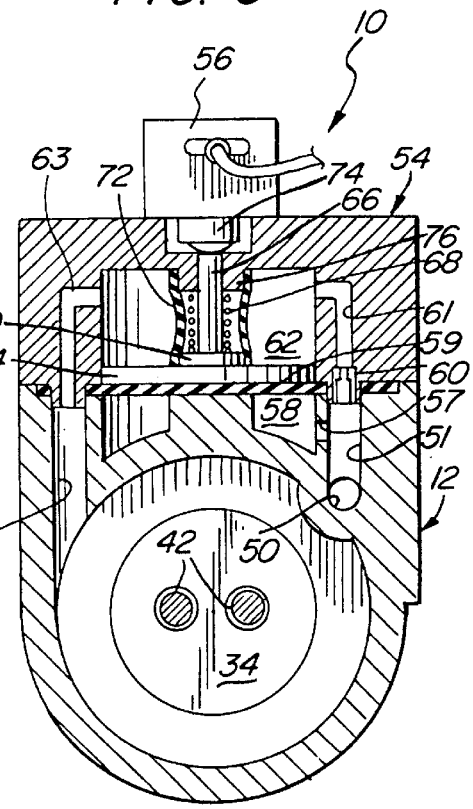
FIG. 3 is a partial cross sectional view taken along line 3—3 of FIG. 1.
Figure 2:
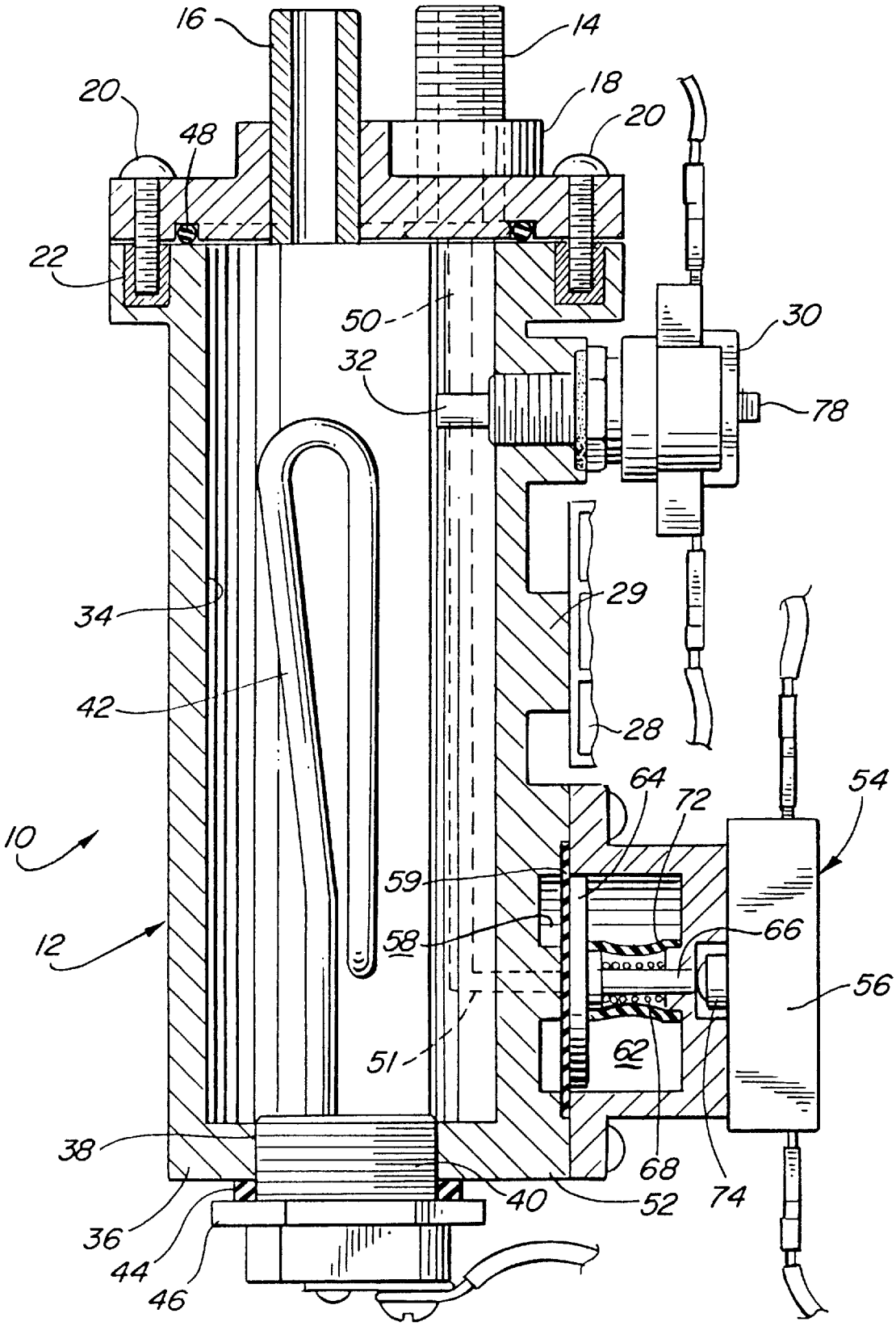
FIG. 2 is a partial cross sectional view taken along line 2—2 of FIG. 1.

Cold water entering the cold water inlet 14 flows through a dedicated water passageway 50 formed in the body 12, and shown in broken line in FIG. 2 at one side of the body 12. As shown in FIGS. 2 and 3, the water passageway 50 takes a 90° turn toward the lower end 36 of the body 12 so as to form a perpendicular passageway 51. The perpendicular passageway 51 ends at a further elevated or raised portion 52 mounted on the front of the body 12. A means for sensing flow of cold water, and for actuating the heat element, generally identified as 54 is releasably mounted on portion 52, by means of a plurality of securing elements 55, such as screws, or the like.

It should be pointed out that the broken wires shown connected to the limit switch 30, the end 40 of the heating element 42, and the flow sensing/heat element activating means 54 are all connected to the terminal block 28, in a known manner. Additionally, power is brought to the terminal block, in a known manner, via a power cord, which is connected to an outlet.

The operation of the device of the present invention, including the flow sensing/heat activating means 54 will now be described. As previously explained, cold water from a cold water line attached to inlet 14 will enter inlet 14, flow through internal passageway 50, and then through internal passageway 51. This cold water will then flow into an unrestricted passage 57, and enter a first chamber 58, having no outlet, below a resilient element or diaphragm 59, secured between the raised portion 52 of body 12 and the flow sensing/heat element activating means 54. The cold water will also continue through a flow restrictor 60, such as a stainless steel element, into a passageway 61, which is connected to a further or second chamber 62. Chamber 62 includes an outlet passageway 63, which connects to a second passageway 65, into holding chamber 34. A disk 64 is reciprocally mounted within the second chamber 62, and held against an upper or second surface of the diaphragm 59, as by means of a plunger rod 66, having an enlarged head 70 secured to or held against the disk 64. A spring 68 is held around the elongated plunger rod 66 between enlarged head 70, and a further annular portion 76 formed in the chamber 62 adjacent a top portion thereof. A flexible sealing tube 72 is mounted within chamber 62 so that it seals around the enlarged head 72 and the annular portion 76 to provide a water seal over the plunger rod 66 and spring 68. A free or upper end of the plunger rod 66 contacts a plunger switch 74 of microswitch 56, to activate the microswitch upon water flow within the device, as explained more fully below.

As explained above, the diaphragm 59 separates the two chambers 58 and 62. The diaphragm 59 is preferably made of silicon, or some other type of resilient material, such as rubber, or the like. Once the water heater 10 of the present invention is connected, for example, under a sink, between the hot and cold water lines of a water faucet, and a hot water handle or tap is actuated or operated to allow the water to flow from chamber 34 through outlet 16, the pressure in chamber 62 will be lowered whereby the higher cold water pressure in chamber 58 will move the diaphragm 59 outwardly, against the action of the spring 68. The higher pressure in chamber 58 occurs because of the flow restrictor 60 between the passageways 51 and 61. That is, the water pressure in the first chamber 58 will be higher than that in the second chamber 62, so that the diaphragm 59 and disk 64 move against the bias of spring 68, toward the microswitch 56. This movement brings the upper end of plunger rod 66 into contact with the plunger switch 74 to activate the microswitch 56, to thereby activate the heating element 42, and substantially instantly heat the water in chamber 34. Once the open hot water tap is closed, hot water will no longer exit the chamber 34 through outlet 16, and the pressure in chamber 62 will then eventually equal that of the pressure in chamber 58. The spring 68 will bias the disk 64 against the diaphragm 59, to move the plunger rod 66 downwardly, to thereby open the plunger switch 74 and cut off power to the heating element 42. It is understood that spring 68 must be sized and dimensioned so that the force thereof allows the disk 64 and plunger rod 66 to activate the switch 74 upon hot water exiting through the water outlet 16, but of sufficient force to return the disk 64 and plunger rod 66, to the closed position, when the hot water tap connected to outlet 16 is closed.

It is to be understood that the body 12 of the water heater of the present invention is sized and dimensioned so that it may be easily handled and mounted in a vertical position against a wall or a mounting plate (not shown), under a sink, or the like. The water heater works best with the inlet 14 and outlet 16 in the vertical positions shown in FIGS. 1 and 2. Furthermore, it is to be understood, that a protective and/or decorative cover or housing (not shown) should be placed over the water heater 10 of the present invention so as to cover and protect the limit switch 30, the terminal block 28 and the microswitch 56. Such a housing would, of course, need an opening to allow a power supply to be inserted therein and connected to the terminal block 28, so as to power the water heater. Additionally, a round opening is formed on the housing so as to be aligned with the reset activating button 78, so as to manually reset the limit switch 30, in a manner well known to those skilled in the art.

It, therefore, can be seen that the present invention provides an improved tankless water heater, which delivers instant hot water upon actuation of a hot water faucet to which it is connected. The device includes a combination flow sensing and heat element-activating portion connected to and controlled by the flow of cold water entering and exiting the same.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. An improved "in-line" tankless water heater for interconnection between an electrical power supply, a cold water inlet line and a hot water supply line; the water heater, comprising:

an elongated body having a top and a bottom;

a temperature limit switch, a terminal block and a microswitch mounted on an exterior surface of the elongated body;

the microswitch being carried on a lower portion of the elongated body, over a pair of chambers, secured to the elongated body;

a cold water inlet and a hot water outlet held in the top;

an elongated passage formed internally of the elongated body in fluid communication between the cold water inlet and the pair of chambers;

the pair of chambers being separated by a resilient element;

a first of the pair of chambers having an inlet and no outlet;

a second of the pair of chambers having an inlet and an outlet;

a heating element held in an elongated water heating chamber formed in the elongated body;

the elongated water heating chamber being in fluid communication with the outlet of the second of the pair of chambers and the hot water outlet; and means for actuating the microswitch to activate the heating element and heat the water in the elongated water heating chamber.

2. The "in-line" tankless water heater of claim 1 wherein the means for actuating the microswitch is responsive to flow of cold water from the second of the pair of chambers, upon opening of a tap in the hot water line.

3. The "in-line" tankless water heater of claim 2, further including a flow restrictor between the first of the pair of chambers and the second of the pair of chambers; and wherein the flow of cold water into the first of the pair of chambers acts against a first side of the resilient element to move the resilient element toward the microswitch when the cold water in the second of the pair of chambers flows into the elongated water heating chamber, upon flow of water from the elongated water heating chamber through the hot water oulet into the hot water supply line.

4. The "in-line" tankless water heater of claim 3, further including a reciprocating disk member having a plunger rod held in the second of the pair of chambers, with the disk member held against a second side of the resilient element.

5. The "in-line" tankless water heater of claim 3, further including a biasing element, mounted on the plunger rod, between an operating member of the microswitch and the disk member; the biasing element normally holding the disk member against the resilient element, and the resilient element in a rest position.

6. The "in-line" tankless water heater of claim 5 wherein the heating element is an elongated member held in the bottom of the elongated body so as to extend into the elongated water-heating chamber, and the cold water inlet and the hot water outlet are attached to a manifold connected to the top.

7. The "in-line" tankless water heater of claim 1 wherein the means for actuating the microswitch is responsive to the flow of cold water from the second of the pair of chambers, upon opening of the hot water supply line and comprises a diaphragm held between and separating the first of the pair of chambers and the second of the pair of chambers, and a plunger actuator in the second of the pair of chambers for actuating a plunger switch connected to the microswitch.

8. The "in-line" tankless water heater of claim 7, further including a reciprocating disk member attached to a plunger rod held in the second of the pair of chambers, with the disk member held against the resilient element.

9. The "in-line" tankless water heater of claim 8, further including a spring, mounted on the plunger rod, between the plunger switch and the disk member; the spring normally biasing the disk member against the resilient member.

10. The "in-line" tankless water heater of claim 8 wherein the heating element is an elongated member held in the bottom of the elongated body so as to extend into the elongated water-heating chamber, and the cold water inlet and the hot water outlet are attached to a manifold connected to the top.

11. An improved "in-line" tankless water heater for interconnection between an electrical power supply, a cold water inlet line and a hot water supply line; the water heater, comprising:

an elongated body having a top and a bottom;

a manifold connected to the top, having a cold water inlet and a hot water outlet attached to the manifold;

a temperature limit switch, a terminal block and a microswitch mounted on an exterior surface of the elongated body, between the top and the bottom;

the microswitch being carried on a lower portion of the elongated body, over a first chamber and a second chamber, and being secured to the elongated body;

an elongated passage formed internally of the elongated body and in fluid communication between the cold water inlet and the pair of chambers;

the first chamber and the second chamber being separated by a resilient element;

the first chamber having an inlet and no outlet;

the second chamber having an inlet and an outlet;

a heating element held in an elongated water heating chamber formed in the elongated body, beside the elongated passage;

the elongated water heating chamber being in fluid communication with the outlet of the second chamber and the hot water outlet; and a movable plunger contacting the microswitch to activate the heating element and heat the water in the elongated water heating chamber, upon movement of the resilient element.

12. The "in-line" tankless water heater of claim 11 wherein the plunger includes a plunger rod and a lower disk, which lower disk and plunger rod move in response to flow of cold water from the second chamber upon opening of a tap in the hot water line.

13. The "in-line" tankless water heater of claim 12 wherein the resilient element is a diaphragm held between and separating the first chamber and the second chamber, and the plunger disk rests against a first side of the diaphragm and the plunger rod, and is in the second chamber where it actuates a plunger switch connected to the microswitch, upon movement of the diaphragm.

14. The "in-line" tankless water heater of claim 13, further including a spring held over the plunger rod and an annular element in the second chamber; and the spring biases the disk against the first side of the diaphragm.

15. The "in-line" tankless water heater of claim 14 wherein the plunger rod actuates a plunger switch on the microswitch to operate the heating element.

16. The "in-line" tankless water heater of claim 15 wherein the heating element is an elongated member held in the bottom of the elongated body so as to extend into the elongated water-heating chamber, beside the elongated passage.

17. An improved "in-line" tankless water heater for interconnection between an electrical power supply, a cold water inlet line and a hot water supply line; the water heater, comprising:

an elongated body having a top and a bottom;

a manifold releasably secured to the top and having a cold water inlet and a hot water outlet secured in the manifold;

a temperature limit switch, a terminal block and a microswitch mounted on an exterior surface of the elongated body, between the top and the bottom;

the microswitch being carried on a lower portion of the elongated body, over a first chamber and a second chamber secured to the elongated body;

an elongated passage formed internally of the elongated body and in fluid communication between the cold water inlet and the pair of chambers;

the first chamber and the second chamber being separated by a diaphragm;

the first chamber having an inlet and no outlet;

the second chamber having an inlet and an outlet;

an elongated heating element held in an elongated water heating chamber formed in the elongated body, beside the elongated passage;

the elongated water heating chamber being in fluid communication with the outlet of the second chamber and the hot water outlet; and a movable plunger held against a side of the diaphragm for actuating the microswitch to activate the heating element and heat the water in the elongated water heating chamber, in response to flow of cold water from the second of the pair of chambers, upon opening of a tap in the hot water line.

18. The "in-line" tankless water heater of claim 17 wherein the movable plunger includes a reciprocating disk member attached to a plunger rod held in the second of the pair of chambers, with the disk member held against the side of the diaphragm.

19. The "in-line" tankless water heater of claim 18, further including a biasing element, mounted on the plunger rod, between an operating member of the microswitch and the disk member; the biasing element holding the disk member against the diaphragm.

20. The "in-line" tankless water heater of claim 19 wherein the heating element is an elongated member held in the bottom of the elongated body so as to extend into the elongated water-heating chamber.

* * * * *